US008982035B2

(12) United States Patent
Seo et al.

(10) Patent No.: US 8,982,035 B2
(45) Date of Patent: Mar. 17, 2015

(54) METHOD OF DRIVING A LIGHT SOURCE, BACKLIGHT APPARATUS FOR PERFORMING THE METHOD AND LIQUID CRYSTAL DISPLAY APPARATUS HAVING THE BACKLIGHT APPARATUS

(75) Inventors: Young-Jun Seo, Seoul (KR); Gi-Cherl Kim, Yongin-si (KR); Se-Ki Park, Suwon-si (KR); Dong-Min Yeo, Asan-si (KR)

(73) Assignee: Samsung Display Co., Ltd. (KR)

( * ) Notice: Subject to any disclaimer, the term of this patent is extended or adjusted under 35 U.S.C. 154(b) by 592 days.

(21) Appl. No.: 12/700,006

(22) Filed: Feb. 4, 2010

(65) Prior Publication Data

US 2010/0214209 A1 Aug. 26, 2010

(30) Foreign Application Priority Data

Feb. 20, 2009 (KR) ..... 10-2009-0014478

(51) Int. Cl.
*G09G 3/36* (2006.01)
*G09G 3/34* (2006.01)

(52) U.S. Cl.
CPC ..... *G09G 3/3611* (2013.01); *G09G 3/342* (2013.01); *G09G 3/3426* (2013.01); *G09G 2320/0233* (2013.01); *G09G 2320/0247* (2013.01); *G09G 2320/0646* (2013.01); *G09G 2360/16* (2013.01)
USPC ..... 345/102; 348/467; 348/465; 348/558; 345/419

(58) Field of Classification Search
CPC ..... G09G 2300/0452; G09G 2300/0465; G09G 2310/0232; G09G 2320/0233; G09G 2320/0271; G09G 2320/0276; G09G 2320/064; G09G 2320/0646; G09G 2330/021; G09G 3/2074; G09G 3/342; G09G 3/3466
USPC ..... 345/102; 715/201; 348/465, 467, 558
See application file for complete search history.

(56) References Cited

U.S. PATENT DOCUMENTS

2005/0184952 A1 8/2005 Konno et al.
2005/0231457 A1 10/2005 Yamamoto et al.

(Continued)

FOREIGN PATENT DOCUMENTS

CN 1655024 A 8/2005
CN 1702730 A 11/2005

(Continued)

OTHER PUBLICATIONS

European Office Action for Application No. 10 001 181.6-1228 dated Nov. 17, 2011.

(Continued)

*Primary Examiner* — William L Boddie
*Assistant Examiner* — Sahlu Okebato
(74) *Attorney, Agent, or Firm* — Cantor Colburn LLP

(57) ABSTRACT

A method of driving a light source including a light source module which provides a liquid crystal display panel with light and is driven through a dimming method according to a plurality of driving blocks, the method including; calculating gradation data of an image block of the liquid crystal display panel from an external image signal by dividing the image block into a plurality of sub-blocks, determining a duty ratio of a driving signal which drives an individual driving block of the plurality of driving blocks, the individual driving block corresponding to the image block based on the gradation data, and driving the individual driving block in accordance with the duty ratio.

16 Claims, 6 Drawing Sheets

(56) References Cited

U.S. PATENT DOCUMENTS

| | | | | |
|---|---|---|---|---|
| 2006/0007103 | A1* | 1/2006 | Oh et al. | 345/102 |
| 2007/0152951 | A1* | 7/2007 | Ahn | 345/102 |
| 2008/0129760 | A1* | 6/2008 | Phan | 345/690 |
| 2009/0080531 | A1* | 3/2009 | Hashiguchi et al. | 375/240.24 |

FOREIGN PATENT DOCUMENTS

| | | | |
|---|---|---|---|
| CN | 1967643 | A | 5/2007 |
| CN | 101303839 | A | 11/2008 |
| EP | 1939850 | A1 | 7/2008 |
| JP | 09-181994 | A | 7/1997 |
| JP | 3379453 | B2 | 12/2002 |
| JP | 2004-177722 | A | 6/2004 |
| JP | 2008-258929 | A | 10/2008 |
| KR | 1020070088148 | A | 8/2007 |

OTHER PUBLICATIONS

European Search Report; Aug. 12, 2010; P 18795EP; 10001181.6-1228 / 2221796.

"Power savings and enhancement of gray-scale capability of LCD TVs with an adaptive dimming technique"; Tomokazu Shiga et al: Journal of the Society for Information Display—SID, Society for Information Display Lnkd—DOI: 10.1889/1.2841865, vol. 16, No. 2, Feb. 1, 2008, pp. 311-316, XP002579976 ISSN: 1071-0922.

"39.1: Adaptive Dimming and Boosting Backlight for LCD-TV Systems", Pierre De Greef and Hendriek Groot Hulze NXP Semiconductors (Founded by Philips) et al; SID 2007, 2007 SID International Symposium, Society for Information Display, Los Angeles, USA, vol. XXXVIII, May 20, 2007, pp. 1332-1335, XP007013259 ISSN: 0007-966X.

* cited by examiner

METHOD OF DRIVING A LIGHT SOURCE, BACKLIGHT APPARATUS FOR PERFORMING THE METHOD AND LIQUID CRYSTAL DISPLAY APPARATUS HAVING THE BACKLIGHT APPARATUS

This application claims priority to Korean Patent Application No. 2009-14478, filed on Feb. 20, 2009, and all the benefits accruing therefrom under 35 U.S.C. §119, the content of which in its entirety is herein incorporated by reference.

BACKGROUND OF THE INVENTION

1. Field of the Invention

Exemplary embodiments of the present invention relate to a method of driving a light source. More particularly, exemplary embodiments of the present invention relate to a method of driving a light source for enhancing display quality, a backlight apparatus for performing the method and a liquid crystal display apparatus having the backlight apparatus.

2. Description of the Related Art

Generally, a liquid crystal display ("LCD") device typically includes an LCD panel that displays an image using the light transmittance characteristics of liquid crystal molecules, and a backlight assembly disposed below the LCD panel to provide the LCD panel with light.

The LCD panel typically includes an array substrate, an opposite substrate and a liquid crystal layer. The array substrate typically includes a plurality of signal lines, a plurality of thin-film transistors ("TFTs") respectively connected to the plurality of signal lines and a plurality of pixel electrodes respectively connected to the plurality of TFTs. The opposite substrate faces the array substrate and has a common electrode. The liquid crystal layer is interposed between the array substrate and the opposite substrate. When an electric field is applied to the liquid crystal layer, the arrangement of liquid crystal molecules of the liquid crystal layer is altered to change light transmittance, so that an image is displayed. Here, when the light transmittance is increased to a maximum, the LCD panel may display a white image having high luminance. Alternatively, when the light transmittance is decreased to a minimum, the LCD panel may display a black image having relatively low luminance.

Moreover, in order to prevent the contrast ratio ("CR") of an image from decreasing and to minimize power consumption, a local dimming driving method has recently been developed. In the local dimming driving method, a light source providing light to the LCD panel is divided into a plurality of light-emitting blocks. The light emitting blocks may be driven to control an amount of light displayed thereby in correspondence with the luminance of an image corresponding to the light-emitting blocks.

The local dimming driving method employed in a backlight typically includes a global dimming method, a one-dimensional (1-D) dimming method, a two-dimensional (2-D) dimming method, a three-way dimming method, a boosting method, or various other methods. The global dimming method (or, O-D dimming method) is a method in which the luminance of the display image is entirely adjusted, e.g., the entire backlight is dimmed or brightened according to a corresponding display image. The 1-D dimming method is that in which the luminance of the display image is adjusted by predetermined lines such as a horizontal line or a vertical line. The 2-D dimming method is that in which the luminance of the display image is partially adjusted in accordance with a position of the display image with respect to an x-axis and a y-axis. The 3-way dimming method is that in which a luminance image is dimmed by using position information and color information. The boosting method such as an adaptive luminance and power control ("ALPC") is a method wherein a luminance image is increased so as to increase image quality.

However, since the local dimming driving method is a driving method in which driving is performed in blocks, flicker is generated due to subtitles in multimedia contents such as a movie. In particular, since an entire screen is dimmed or boosted by the global dimming method and the boosting method, flicker is generated due to a luminance difference between frames. Moreover, the number of blocks is small in the 1-D dimming method, so that a luminance difference between blocks may be undesirably perceived by a viewer within the same frame. Furthermore, in the 2-D dimming method, flicker is generated due to a luminance difference of blocks including subtitles.

In addition, when driving blocks are increased as a solution to the above in order to decrease the flicker due to the subtitles, the number of driving integrated circuits ("ICs") is increased. Thus, a great number of driving blocks may not be used in the global dimming method or the 1-D dimming method, and the flicker due to the boosting method may not be prevented.

BRIEF SUMMARY OF THE INVENTION

Exemplary embodiments of the present invention provide a method of driving a light source for enhancing display quality.

Exemplary embodiments of the present invention also provide a backlight apparatus for performing the above-mentioned method.

Exemplary embodiments of the present invention further also provide a liquid crystal display apparatus having the above-mentioned backlight apparatus.

According to one exemplary embodiment of the present invention a method of driving a light source including a light source module which provides a liquid crystal display panel with light and is driven through a dimming method according to a plurality of driving blocks, the method including; calculating gradation data of an image block of the liquid crystal display panel from an external image signal by dividing the image block into a plurality of sub-blocks, determining a duty ratio of a driving signal which drives an individual driving block of the plurality of driving blocks, the individual driving block corresponding to the image block based on the gradation data, and driving the individual driving block in accordance with the duty ratio.

In an exemplary embodiment of the present invention, wherein calculating the gradation data of the image block from the external image signal includes dividing the image block into a plurality of sub-blocks, determining whether each of the sub-blocks includes non-image data, and calculating the gradation data of the image block excluding the non-image data when each of the sub-blocks includes the non-image data.

In an exemplary embodiment of the present invention, the non-image data may include subtitle data.

In an exemplary embodiment of the present invention, determining whether each of the sub-blocks includes the non-image data includes obtaining a maximum gradation value and an average gradation value of each of the sub-blocks from the image signal corresponding to the each of the sub-blocks, respectively, and determining whether the maximum gradation value exceeds a first reference value and a difference between the maximum gradation value and the average gradation value exceeds a second reference value which is smaller than the first reference value, and determining the sub-block to be a subtitle block, which includes subtitle data, when the maximum gradation value exceeds the first reference value and the difference between the maximum gradation value and the average gradation value exceeds the second reference value.

In an exemplary embodiment of the present invention, calculating the gradation data of the image block includes excluding the maximum gradation value of the sub-block that is determined as the subtitle block.

In an exemplary embodiment of the present invention, the number of sub-blocks determined to be the subtitle block may be about 20% to about 30% of the total number of sub-blocks.

In an exemplary embodiment of the present invention, each size of the sub-blocks determined to be subtitle blocks may be different from each other.

In an exemplary embodiment of the present invention, determining whether or not each of the sub-blocks includes non-image data may include determining the sub-block to be a dark block when the maximum gradation value is no greater than the first reference value, a difference between the maximum gradation value and the average gradation value is no greater than the second reference value, the maximum gradation value is less than a third reference value which is smaller than the first reference value, and the average gradation value is less than a fourth reference value which is smaller than the third reference value.

In an exemplary embodiment of the present invention, a duty ratio between adjacent driving blocks may further be compensated.

In an exemplary embodiment of the present invention, a size of the sub-blocks may be greater than a pixel of the liquid crystal display panel, and may be equal to or smaller than half of the image block.

In an exemplary embodiment of the present invention, the light source module may drive at least one driving block through a dimming method. Moreover, the light source module may drive driving blocks, which are divided into a first direction, through a dimming method according to a driving block.

According to one exemplary embodiment of the invention, a backlight apparatus includes a light source module and a local dimming driving part. The light source module provides a liquid crystal display (LCD) panel with light. The light source module is driven through a dimming method according to a plurality of driving blocks. The local dimming driving part includes an image analyzing part, a duty determining part and a light source driving part. The image analyzing part divides an image block of the LCD panel into a plurality of sub-blocks to calculate gradation data of the image block from an external image signal. The duty determining part determines a duty ratio of a driving signal which drives an individual driving block of the plurality of driving blocks. The individual driving block corresponds to the image block based on the gradation data. The light source driving part drives the individual driving block in accordance with the duty ratio.

In an exemplary embodiment of the present invention, the image analyzing part may determine whether each of the sub-blocks includes non-image data. The image analyzing part may calculate the gradation data of the image block excluding the non-image data when each of the sub-blocks includes the non-image data.

In an exemplary embodiment of the present invention, the image analyzing part may obtain a maximum gradation value and an average gradation value of each of the sub-blocks from the image signal corresponding to the each of the sub-blocks, respectively. The image analyzing part may determine whether the maximum gradation value exceeds a first reference value and a difference between the maximum gradation value and the average gradation value exceeds a second reference value which is smaller than the first reference value. The image analyzing part may determine the sub-block to be a subtitle block, which includes subtitle data, when the maximum gradation value exceeds the first reference value and the difference between the maximum gradation value and the average gradation value exceeds the second reference value.

In an exemplary embodiment of the present invention, the image analyzing part may determine the sub-block to be a dark block when the maximum gradation value is no greater than the first reference value. A difference between the maximum gradation value and the average gradation value may be no greater than the second reference value, the maximum gradation value may be less than or equal to a third reference value which is smaller than the first reference value, and the average gradation value may be less than or equal to a fourth reference value which is smaller than the third reference value.

In an exemplary embodiment of the present invention, wherein the local dimming driving part may further include a duty compensation part which compensates a duty ratio between driving blocks B that are adjacent to each other.

In an exemplary embodiment of the present invention, the light source module may drive at least one driving block through a dimming method.

In an exemplary embodiment of the present invention, the light source module may drive driving blocks, which are divided along a first direction, through a dimming method in which driving is performed in driving blocks.

According to one exemplary embodiment of the invention, a liquid crystal display (LCD) apparatus includes an LCD panel and a backlight apparatus. The backlight apparatus includes a light source module and a local dimming driving part. The light source module provides a liquid crystal display (LCD) panel with light. The light source module is driven through a dimming method according to a plurality of driving blocks. The local dimming driving part includes an image analyzing part, a duty determining part and a light source driving part. The image analyzing part divides an image block of the LCD panel into a plurality of sub-blocks to calculate gradation data of the image block from an external image signal. The duty determining part determines a duty ratio of a driving signal which drives an individual driving block of the plurality of driving blocks. The individual driving block corresponds to the image block based on the gradation data. The light source driving part drives the individual driving block in accordance with the duty ratio.

In an exemplary embodiment of the present invention, the light source module may drive at least one driving block through a dimming method.

In an exemplary embodiment of the present invention, the light source module may drive driving blocks, which are divided along a first direction, through a dimming method in which driving is performed in driving blocks.

According to some exemplary embodiments of the present invention, the duty of a driving signal of a driving block is determined excluding non-image information such as subtitles, so that the display quality of an image may be enhanced. Moreover, gradation data determining the duty of a driving signal is calculated by dividing an image block corresponding to a driving block into a plurality of imaginary sub-blocks, so that accurate luminance control may be possible without an addition of a driving circuit.

BRIEF DESCRIPTION OF THE DRAWINGS

The above and other aspects, features and advantages of the present invention will become more apparent by describing in further detail exemplary embodiments thereof with reference to the accompanying drawings, in which.

DETAILED DESCRIPTION OF THE INVENTION

Figure 1:
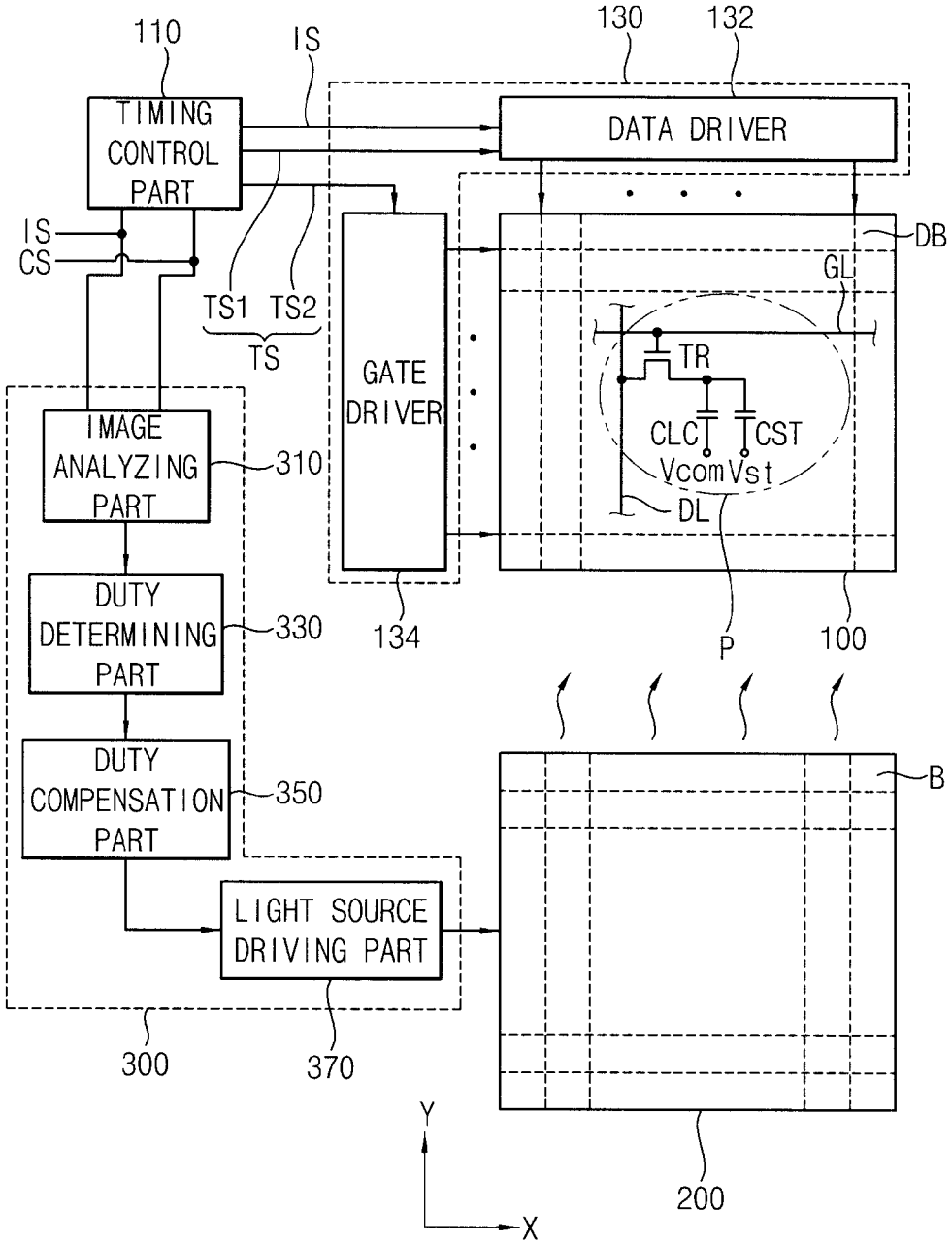
FIG. 1 is a block diagram illustrating an exemplary embodiment of a display device according to the present invention.

The present invention now will be described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. Like reference numerals refer to like elements throughout.

It will be understood that when an element or layer is referred to as being "on" another element, it can be directly on the other element or intervening elements may be present. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be explained in detail with reference to the accompanying drawings.

Figure 2:
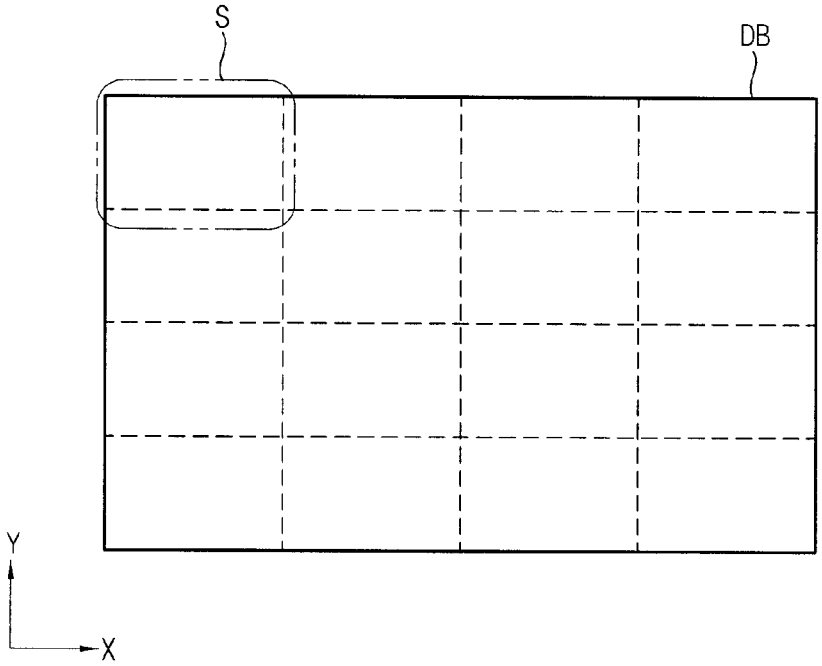
FIGS. 2 to 4 are schematic diagrams illustrating exemplary embodiments of sub-blocks of the image block of FIG. 1.
Figure 3:
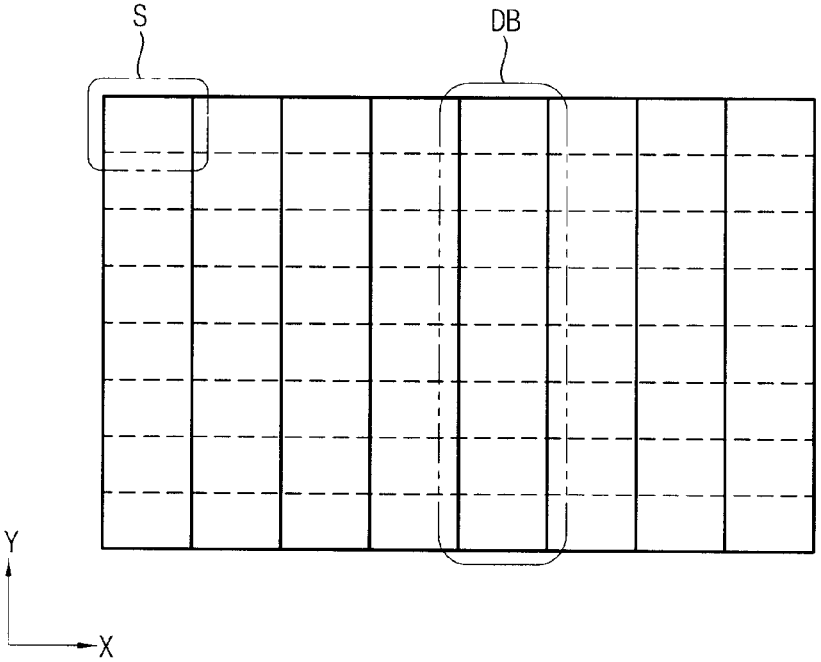
Figure 4:
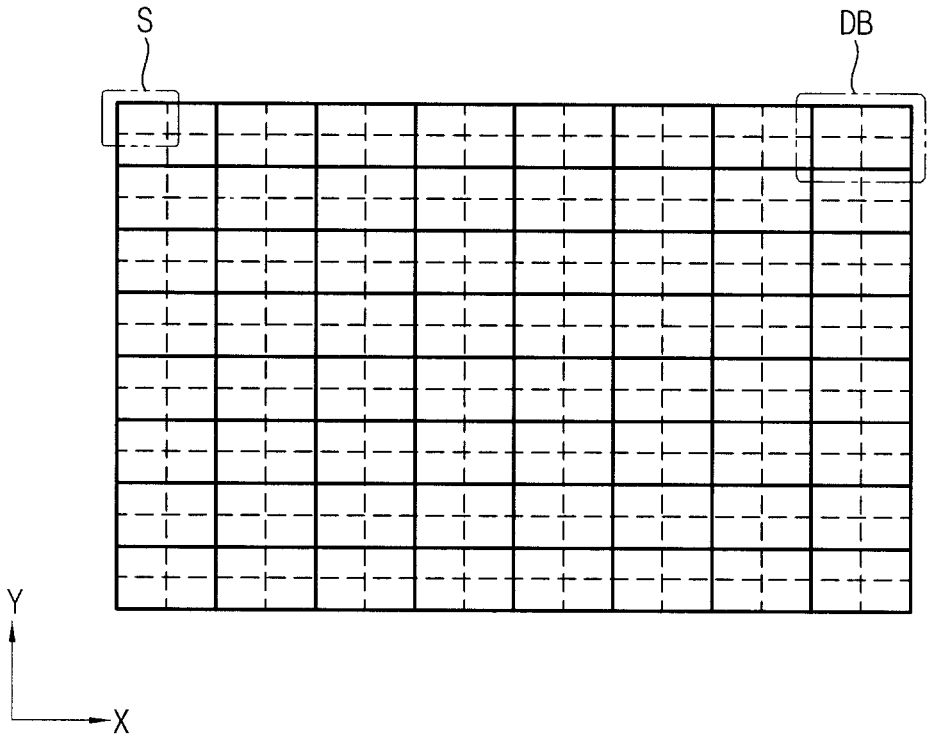

FIG. 1 is a block diagram illustrating an exemplary embodiment of a display device according to the present invention. FIGS. 2 to 4 are schematic diagrams illustrating exemplary embodiments of sub-blocks of the image block of FIG. 1.

Referring to FIG. 1, the present exemplary embodiment of a display device includes a display panel 100, a timing control part 110, a panel driving part 130, a light source module 200, and a local dimming driving part 300.

The display panel 100 displays an image using an image signal provided from an external device (not shown). The display panel 100 may be divided into a plurality of image blocks DB. The image block DB may correspond to a driving block B of a light source module 200 to receive light from the corresponding driving block B, e.g., in one exemplary embodiment the image block DB and the driving block B may be aligned with one another.

The display panel 100 includes a plurality of pixels P for displaying images. For example, in one exemplary embodiment the number of the pixels P may be M×N (wherein, 'M' and 'N' are natural numbers). Each of the pixels P includes a switching element TR connected to a gate line GL and a data line DL, and a liquid crystal capacitor CLC and a storage capacitor CST that are connected to the switching element TR.

The timing control part 110 receives a control signal CS and an image signal IS from an external device (not shown). Exemplary embodiments of the control signal CS may include a vertical synchronizing signal (Vsync), a horizontal synchronizing signal (Hsync), and a clock signal among other similar signals. The vertical synchronizing signal Vsync represents a time required for displaying one frame. The horizontal synchronizing signal Hsync represents a time required for displaying one line of the frame. Thus, the horizontal synchronizing signal includes pulses corresponding to the number of pixels included in one horizontal line. The timing control part 110 generate a timing control signal TS which controls a driving timing of the panel driving part 130 using the control signal CS.

The panel driving part 130 drives the display panel 100 using the timing control signal TS and the image signal IS received from the timing control part 110.

Exemplary embodiments include configurations wherein the panel driving part 130 may include a data driver 132 and a gate driver 134. In such an exemplary embodiment, the timing control signal TS includes a first control signal TS1 for controlling a driving timing of the data driver 132 and a second control signal TS2 for controlling a driving timing of the gate driver 134. Exemplary embodiments of the first control signal TS1 may include a clock signal and a horizontal start signal, and exemplary embodiments of the second control signal TS2 may include a vertical start signal.

The data driver 132 generates a plurality of data signals using the first control signal TS and the image signal IS, and provides the plurality of data lines DL with the generated data signals.

The gate driver 134 generates a gate signal which activates the gate line GL using the second control signal TS2, and provides the gate line GL with the generated gate signal.

In the present exemplary embodiment, the light source module 200 includes a printed circuit board ("PCB") in which a light source is mounted for providing the display panel 100 with light. In one exemplary embodiment, the light source may include a fluorescent lamp. Alternative exemplary embodiments include configurations wherein the light source may include a plurality of light-emitting diodes ("LEDs"). For example, in one exemplary embodiment the plurality of LEDs may include a plurality of white LEDs. In another exemplary embodiment, the LED may include a red LED, a green LED and a blue LED.

The light source module 200 includes at least one driving block B to be driven through a dimming method. The driving block B corresponds to an image block DB of the display panel 100 to provide light corresponding to the image block DB as described above. For example, in one exemplary embodiment the light source module 200 may include at least one driving block B. In such an exemplary embodiment, the luminance of an entire screen may be controlled (i.e., a global dimming). In another exemplary embodiment, the light source module 200 may include a plurality of driving blocks B divided in an x-axis direction or a y-axis direction. In such an exemplary embodiment, luminance of the light source module 200 may be controlled according to each of the driving blocks B (i.e., 1-dimensional dimming). In still another exemplary embodiment, the light source module 200 may include a plurality of driving blocks B arranged in a matrix shape which is divided into an x-axis direction and a y-axis direction (i.e., 2-dimensional dimming). In further still another exemplary embodiment, driving signals provided to each of the driving blocks B may be generated in response to luminance information and color information (i.e., 3-way dimming). In one exemplary embodiment, the light source module 200 may employ a boosting driving method such as an adaptive luminance and power control ("ALPC") method, which increases luminance during the display of a predetermined image so as to increase image quality, e.g., if the image signal corresponding to the plurality of image blocks DB is a bright image, the driving blocks B may be driven to increase their luminosity.

The local dimming driving part 300 includes an image analyzing part 310, a duty determining part 330 and a light source driving part 370.

The image analyzing part 310 analyzes an image signal of an image block DB of the display panel 100 corresponding to the driving block B.

The image analyzing part 310 divides the image block DB into a plurality of sub-blocks S to calculate gradation data of each of the image blocks DB. In one exemplary embodiment, each of the image blocks DB may be divided into the sub-blocks S having the same size. Alternative exemplary embodiments include configurations wherein each of the image blocks DB may be divided into the sub-blocks S having the different sizes.

Referring to FIG. 2, in the global dimming driving method, gradation data required to determine the duty ratio of a driving signal may be calculated by dividing one image block DB into sixteen sub-blocks S. In FIG. 2, the image block DB may be divided by four in both an x-axis direction and a y-axis direction, i.e., the image block DB is divided into four rows and four columns of sub-blocks S. Alternative exemplary embodiments include configurations wherein the image block DB may be divided by an x-axis direction or a y-axis direction only (not shown). The number of divided sub-blocks S may be determined in accordance with a user's requirements.

As shown in FIG. 3, in an exemplary embodiment of a one-dimensional dimming driving method, each of eight image blocks DB is divided into eight sub-blocks S, and a total sixty-four sub-blocks S may be used in a calculation of gradation data. In such an exemplary embodiment, gradation data calculation which is required to determine the duty ratio of a driving signal without an additional driving IC may be calculated in a manner similar to a 2-dimensional dimming driving method. In FIG. 3, each of the image blocks DB is divided into eight sub-blocks S along a y-axis direction. Alternative exemplary embodiments include configurations wherein the image blocks DB may be divided into eight sub-blocks S along an x-axis direction and a y-axis direction, respectively. Moreover, alternative exemplary embodiments include configurations wherein the image blocks DB may be divided into eight sub-blocks S only along an x-axis direction. In an exemplary embodiment, the number of sub-blocks S may be determined in accordance with a user's requirements.

As shown in FIG. 4, in a two-dimensional dimming driving method, 8×8 image blocks DB are each divided into four sub-blocks S, respectively, and a total 256 sub-blocks S may be used in a calculation of gradation data. In FIG. 4, each image blocks DB is divided into two sub-blocks S along an x-axis direction and a y-axis direction, i.e., each of the image blocks DB is subdivided into two rows and two columns of sub-blocks S. Alternative exemplary embodiments include configurations wherein the image blocks DB may be divided into two sub-blocks S along only an x-axis direction or only a y-axis direction. Moreover, alternative exemplary embodiments include configurations wherein the image blocks DB may be divided into eight sub-blocks S only along a y-axis direction. In an exemplary embodiment, the number of sub-blocks S may be determined in accordance with a user's requirements.

As shown in FIGS. 2 to 4, the driving block B is driven according to the image block DB, i.e., the driving blocks B each correspond to an individual image block DB; however, the image block DB may be divided into a plurality of imaginary sub-blocks S in a calculation of gradation data required to determine the duty ratio of a driving signal of the driving block B. Specifically, the image blocks DB may be subdivided into sub-blocks S in order to allow a finer, e.g., higher resolution, determination of the information contained in the image block DB. Since the number of the driving blocks B is not increased, accurate calculation may be possible without an addition of a driving IC and driving limitations.

In one exemplary embodiment, the size of the sub-block S may be greater than that of a pixel P of the display panel 100, and may be smaller than half of the image block DB. Due to usage of the sub-blocks S, the number of blocks used in a calculation of gradation data is increased. Thus, non-image data such as subtitle data, which has information of a relatively small size in comparison with the size of a conventional image block DB, may be correctly recognized and may be calculated and compensated for.

In addition, a memory, a frame buffer, etc., may be needed when each individual information of the pixel P is used in a calculation, so that manufacturing costs and the size of a driving IC are increased. Thus, in the present exemplary embodiments the number of the sub-blocks S is lower than the resolution of a display device. For example, a high-resolution full HDTV has 1920×3×1080 pixels, so in exemplary embodiments of the invention the size of the sub-blocks S is greater than the size of the pixels P.

When one of the image blocks B includes a sub-block S including non-image data influencing the display quality of an image, the image analyzing part 310 excludes the non-image data during a calculation of gradation data of the image block DB. The gradation data of the image block DB is calculated excluding the non-image data, so that the display quality of an image may be enhanced. Therefore, non-image data, such as subtitles, is not used in determining the gradation data of the image block DB within which it is contained.

In one exemplary embodiment, the non-image data may be subtitle data. Although the subtitle data has less relation to a required luminance to realize an image, the subtitle data includes a high level of gradation data, e.g., the subtitle data is usually brighter than the surrounding image. Since subtitles have high gradation data, luminance uniformity may be decreased in an image in which subtitles are included. Moreover, flicker in which a luminance difference between frames or blocks is viewed may be generated. Thus, in the present exemplary embodiments, the luminance of an image is controlled excluding the subtitle data, so that an initial luminance of an image may be realized.

The image analyzing part 310 divides an image signal IS received from an external device (not shown) in correspondence with a plurality of sub-blocks S, and checks whether or not non-image data such as subtitle data is in the image signal IS. The image signal IS may be input in frame units.

For example, in one exemplary embodiment the image analyzing part 310 obtains a maximum gradation value GMAX and an average gradation value GAVG from the image signal IS of each of the sub-blocks S. The image analyzing part 310 may determine whether or not each sub-block S is a subtitle block including subtitles, each sub-block S is a dark block, or each sub-block S is a normal block that is not the subtitle block and the dark block, based on the maximum gradation value GMAX and the average gradation value GAVG of each of the sub-blocks S.

When the maximum gradation value GMAX of the sub-blocks S is greater than a first reference value REF1 and a difference between the maximum gradation value GMAX and the average gradation value GAVG is greater than a second reference value REF2, the sub-block S may be determined to be a subtitle block including subtitles.

In the present exemplary embodiment, the first reference value REF1 and the second reference value REF2 are greater than 0, and the first reference value REF1 is greater than the second reference value REF2. As described above, since subtitles include characters having a high gradation value, the subtitles may influence the display quality of an image. On the other hand, the subtitles may not influence the luminance of an image when subtitles have a low gradation value, so that only subtitles exceeding the first reference value REF1 are filtered. However, an image itself may be a high gradation value image, e.g., a bright image, so that it is determined whether subtitle blocks exist or not using a difference between the maximum gradation value GMAX and the average gradation value GAVG.

Since subtitles do not occupy a predetermined area unlike other images, a value of which the average gradation value GAVG is subtracted from the maximum gradation value GMAX is greater than 0. When the difference between the maximum gradation value GMAX and the average gradation value GAVG is large, the sub-block S may be determined to include subtitles. That is, when the difference between the maximum gradation value GMAX and the average gradation value GAVG is greater than the second reference value REF2, the sub-block S is determined to be a subtitle block and the maximum gradation value GMAX is determined as subtitle data. For example, in an exemplary embodiment wherein a display device has 0 to 266 gradations, the first reference value REF1 is 230 gradations and the second reference value REF2 is 70 gradations.

When the maximum value of the sub-blocks S is no greater than the first reference value REF1 and the difference between the maximum gradation value GMAX and the average gradation value GAVG is no greater than the second reference value REF2, the sub-block S may be determined to be a dark block or a normal block. A third reference value REF3 that is a reference of the maximum gradation value GMAX and a fourth reference value REF4 that is a reference of the average gradation value GAVG may be set in advance, so that it may be determined whether or not the sub-block S is the dark block or the normal block.

For example, in an exemplary embodiment wherein the maximum gradation value GMAX of the sub-block S is no greater than the first reference value REF1 and the difference between the maximum gradation value GMAX and the average gradation value GAVG is no greater than the second reference value REF2, the sub-block S may be determined to be the dark block when the maximum gradation value GMAX is less than the third reference value REF3 and the average gradation value GAVG is equal to or greater than the fourth reference value REF4. In the present exemplary embodiment, the third reference value REF3 is greater than the fourth reference value REF4, and is smaller than the first reference value REF1. For example, in an exemplary embodiment wherein a display device has 0 to 266 gradations, the third reference value REF3 may be 75 gradations and the fourth reference value REF4 may be 50 gradations.

When the sub-block S is not the subtitle block or the dark block, the sub-block S may be determined as the normal block. That is, when the maximum gradation value GMAX of the sub-block S is no greater than the first reference value REF1 and the difference between the maximum gradation value GMAX and the average gradation value GAVG is no greater than the second reference value REF2, the sub-block S may be determined to be the normal block when the maximum gradation value GMAX is greater than the third reference value REF3 and the average gradation value GAVG is equal to or greater than the fourth reference value REF4.

Non-image data influencing display quality does not exist when the image block DB does not include a sub-block S determined as a subtitle block, so that gradation data of an image block DB may be calculated in a conventional calculation.

When the image block DB includes at least one sub-block S determined as a subtitle block, gradation data of the image block DB may be calculated excluding a maximum gradation value GMAX of the sub-block S determined as the subtitle block. Thus, since the gradation data of the image block DB is calculated excluding the maximum gradation value GMAX data corresponding to the sub-title data of the sub-block S determined as the subtitle data, an influence of the subtitle data without regard to the luminance of an image may be prevented so that an initial image luminance may be maintained.

In addition, in order to prevent a luminance from decreasing in an image including only characters, when the number of sub-blocks S determined as the subtitle block is no greater than a percentage range of the total number of the sub-blocks S, the maximum gradation value GMAX of the sub-blocks S may be excluded in a calculation. For example, in one exemplary embodiment, when the number of sub-blocks S determined as the subtitle block is within a range between about 20% to about 30% of the total number of the sub-blocks S, it may be set to exclude subtitle data in a calculation of gradation data of the image block DB.

The duty determining part 330 determines the duty ratio of a driving signal provided from each driving block B corresponding to each image block DB based on gradation data of each image blocks DB output from the image analyzing part 310.

The local dimming driving part 300 may further include a duty compensation part 350. The duty compensation part 350 may compensate a duty ratio between driving blocks B that are adjacent to each other. Each of the driving blocks B is driven in accordance with the duty determined at the duty determining part 330 to provide each of the image blocks DB with light. Thus, when light is provided to each of the image blocks DB, a luminance difference may be generated. When the luminance difference between each of the driving blocks DB is large, a boundary of the image block DB may undesirable be perceived by a viewer. When the duty ratio difference between the driving block B adjacent to each other is large, the duty compensation part 350 increases or decreases the duty ratio of the driving block B so that a luminance difference between driving blocks B adjacent to each other may be decreased. For example, in one exemplary embodiment the duty compensation part 350 may be a spatial filter which performs low-pass filtering of the duty ratio of the driving block B at a spatial axis. Exemplary embodiments include configurations wherein the duty compensation part 350 may be omitted.

The light source driving part 370 generates a plurality of driving signals for driving the driving blocks B based on a duty ratio output from the duty compensation part 350. The light source driving part 370 provides each of the driving blocks B with the driving signals to drive the driving blocks B.

Figure 5:
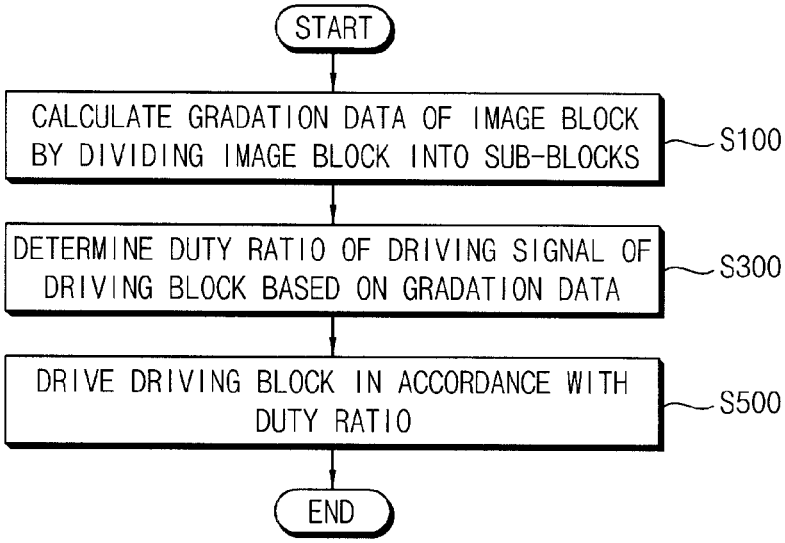
FIG. 5 is a flowchart showing an exemplary embodiment of a method of driving a light source in accordance with the present invention.

FIG. 5 is a flowchart showing an exemplary embodiment of a method of driving a light source in accordance with the present invention.

Referring to FIGS. 1 and 5, in a light source driving method which dimming drives a light source module providing a display panel with light in driving blocks, the image analyzing part 310 calculates gradation data of the image block DB from an external image signal by dividing the image block DB into a plurality of sub-blocks S (step S100).

Then, the duty ratio of a driving signal of the driving block B corresponding to the image block DB is determined based on the calculated gradation data (step S300). In one exemplary embodiment, in step S300, in order to decrease flicker due to a luminance difference between the driving blocks B adjacent to each other, compensation of the duty ratio between the driving blocks B adjacent to each other may be further performed.

The driving block B is driven in accordance with the duty ratio determined in step S300 (step S500). The light source module 200 includes at least one driving block B to be driven through a dimming method in driving blocks B. The display panel 100 displays an image using an image signal provided from an external device. The display panel 100 includes at least one image block DB that is divided in accordance with the driving blocks B. The image block DB receives light from a corresponding driving block B aligned therewith.

The light source module 200 includes at least one driving block B to be driven through a dimming method. The driving block B corresponds to an image block DB of the display panel 100 to provide the corresponding image block DB with light as described above. For example, in one exemplary embodiment the light source module 200 may include at least one driving block B. In such an exemplary embodiment, the luminance of an entire screen may be controlled (i.e., a global dimming). In another exemplary embodiment, the light source module 200 may include a plurality of driving blocks B divided in an x-axis direction or a y-axis direction. In such an exemplary embodiment, the luminance of the light source module 200 may be controlled by each of the driving blocks B (i.e., 1-dimensional dimming). In still another exemplary embodiment, the light source module 200 may include a plurality of driving blocks B of a matrix shape which is divided into an x-axis direction and a y-axis direction (i.e., 2-dimensional dimming). In further still another exemplary embodiment, driving signals provided to each of the driving blocks B may be generated in response to luminance information and color information (i.e., 3-way dimming). In another exemplary embodiment, the light source module 200 may employ a boosting driving method such as an ALPC method, which increases luminance at a predetermined image so as to increase image quality.

Figure 6:
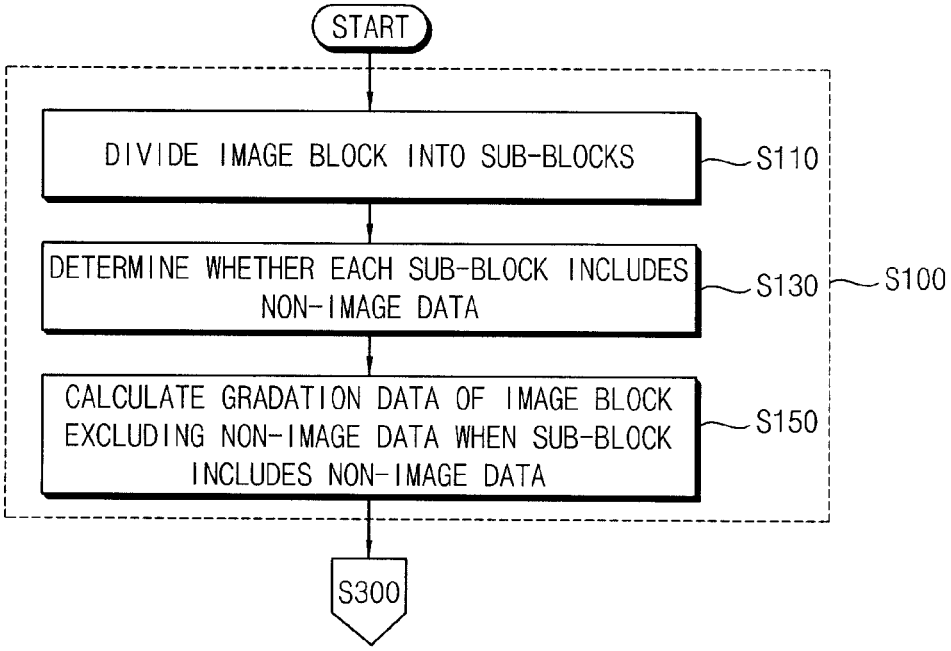
FIG. 6 is a flowchart showing an exemplary embodiment of step S100 of FIG. 5.

FIG. 6 is a flowchart showing step S100 of FIG. 5 in more detail.

Referring to FIG. 6, in step S100 in which the image analyzing part 310 divides an image block DB of the display panel 100 into a plurality of sub-blocks S to calculate gradation data of the image block DB from an image signal provided from an external device, the image block DB is divided into a plurality of sub-blocks S (step S110). Exemplary embodiments include configurations wherein each of the image blocks DB may be divided into a plurality of sub-blocks S having the same size or may be divided into a plurality of sub-blocks S having different sizes. In one exemplary embodiment, each of the image blocks DB may be divided only along an x-axis direction. In another exemplary embodiment, each of the image blocks DB may be divided along an x-axis direction and a y-axis direction. Moreover, the number of divided sub-blocks S may be determined in accordance with a user's requirements.

Exemplary embodiments include configurations wherein the size of the sub-block S may be greater than that of a pixel P of the display panel 100, and may be smaller than half of the image block DB. Due to usage of the sub-block S, the number of blocks used in a calculation of gradation data is increased. Thus, non-image data such as subtitle data, which has information of a relatively small size in comparison with the size of a conventional image block DB, may be correctly recognized and may be calculated. In one exemplary embodiment the number of the sub-blocks S is lower than the resolution of a display device as discussed above.

Then, it is determined whether or not each of the sub-blocks S divided in step S110 (step S130) includes non-image data. The non-image data may be subtitle data. When it is determined whether or not the sub-block S includes the non-image data, the image analyzing part 310 calculates gradation data of the image block DB excluding the non-image data (step S150). When each of the image blocks B includes a sub-block S including non-image data influencing the display quality of an image, the image analyzing part 310 excludes the non-image data during a calculation of gradation data of the image block DB. The gradation data of the image block DB is calculated excluding the non-image data, so that the display quality of an image may be enhanced.

Although the subtitle data has little relation to a required luminance to realize an image, the subtitle data includes high gradation value data, e.g., it is bright. Since subtitles have high gradation value data, luminance uniformity may be decreased in an image in which subtitles are included. Moreover, flicker in which a luminance difference between frames or blocks is viewed may be generated. Thus, the luminance of an image is controlled excluding the subtitle data, so that an initial luminance of an image may be realized.

Figure 7A:
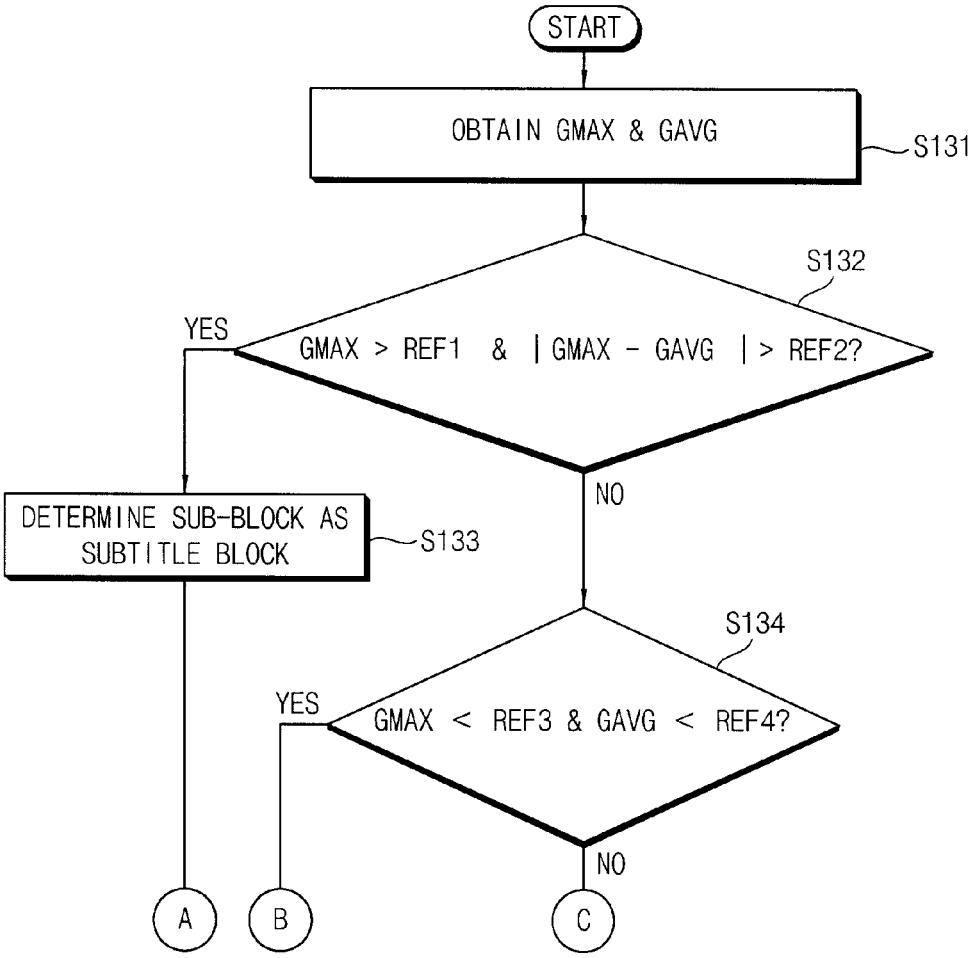
FIGS. 7A and 7B are flowcharts showing an exemplary embodiment of step S130 and step S150 of FIG. 6.
Figure 7B:
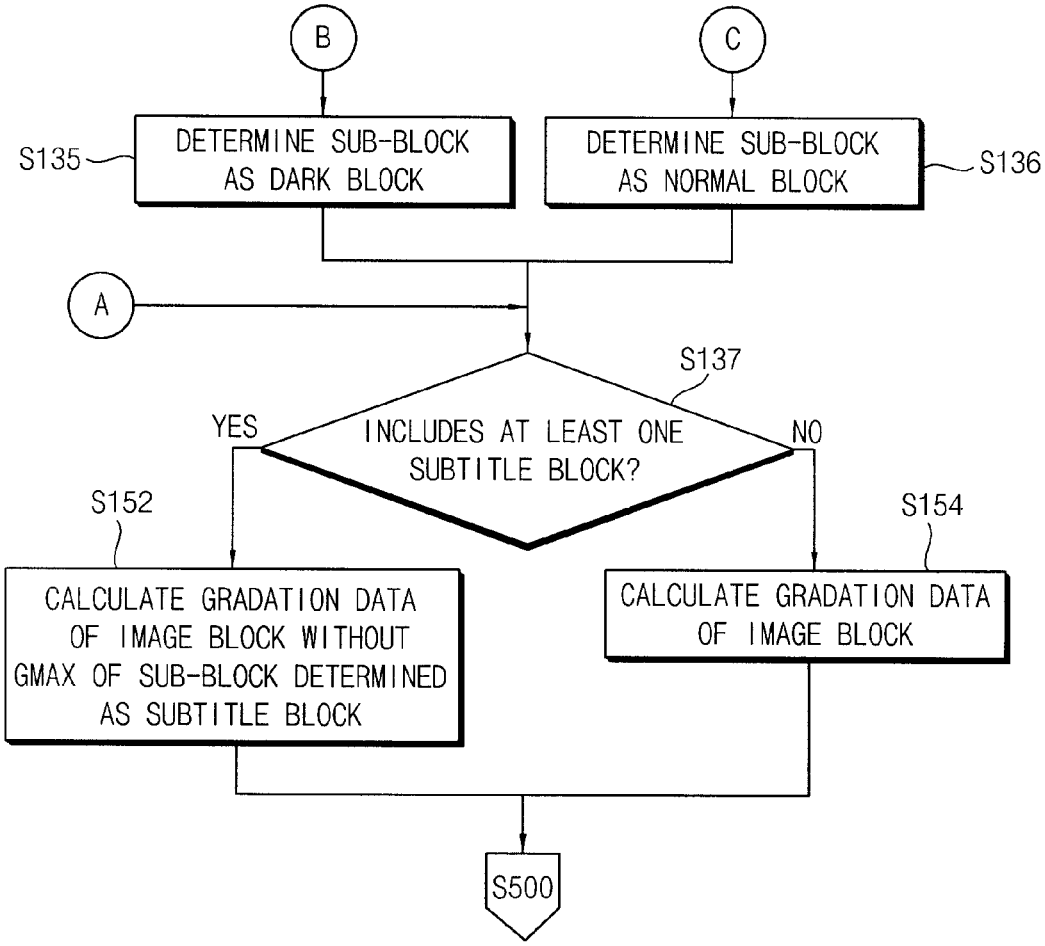

FIGS. 7A and 7B are flowcharts showing step S130 and step S150 of FIG. 6.

Referring to FIG. 7A, in step S130 in which the image analyzing part 310 determines whether or not each sub-block S includes the non-image data, the maximum gradation value GMAX and the average gradation value GAVG of each of the sub-blocks S are obtained from the image signal IS corresponding to each sub-block S (step S131). The image signal IS is received from an external device (not shown). In one exemplary embodiment, the image signal IS may be received in frame units.

It may be determined whether or not each sub-block S is a subtitle block including subtitles, a dark block including substantially entirely dark data, or a normal block that is not the subtitle block or the dark block, based on the maximum gradation value GMAX and the average gradation value GAVG that are obtained in step S131.

For example, in one exemplary embodiment it is determined whether or not the maximum gradation value GMAX of each of the sub-blocks S exceeds the first reference value REF1 and the difference between the maximum gradation value GMAX and the average gradation value GAVG exceeds the second reference value REF2 (step S132). Thus, in step S132, it is determined whether or not the sub-block S is a subtitle block.

In the present exemplary embodiment, the first reference value REF1 and the second reference value REF2 are greater than 0, and the first reference value REF1 is greater than the second reference value REF2. Generally, since subtitles include characters having high gradation value data, the subtitles may influence the display quality of an image. On the other hand, the subtitles may not influence the luminance of an image when subtitles have a low gradation value data, so that only subtitles exceeding the first reference value REF1 are filtered. However, an image itself may be a high gradation value image, so that it is determined whether a subtitle block exists or not using a difference between the maximum gradation value GMAX and the average gradation value GAVG.

Since subtitles do not occupy a predetermined area unlike other images, a value of which the average gradation value GAVG is subtracted from the maximum gradation value GMAX is greater than 0. When the difference between the maximum gradation value GMAX and the average gradation value GAVG is large, the sub-block S may be determined as including subtitles. That is, when the difference between the maximum gradation value GMAX and the average gradation is greater than the second reference value REF2, the sub-block S is determined to be a subtitle block and the maximum gradation value GMAX is determined to be subtitle data. For example, in an exemplary embodiment wherein a display device has 0 to 266 gradations, the first reference value REF1 is determined to be 230 gradations and the second reference value REF2 is determined to be 70 gradations.

When the maximum gradation value GMAX of each sub-block S exceeds the first reference value REF1 and the difference value between the maximum gradation value GMAX and the average gradation value GAVG exceeds the second reference value REF2 in step S132, the sub-block S is determined to be a subtitle block (step S133).

When the maximum gradation value GMAX of the sub-block S is equal to or less than the first reference value REF1 and the difference value between the maximum gradation value GMAX and the average gradation value is equal to or less than the second reference value REF2, it is determined whether or not the maximum gradation value GMAX is less than the third reference value REF3 and the average gradation value GAVG is less than the fourth reference value REF4 (step 134). That is, in step S134, it is determined whether the sub-block S is a dark block or a normal block.

In step S134, when the maximum gradation value GMAX of the sub-block S is less than the third reference value REF3 and the average gradation value GAVG is less than the fourth reference value REF4, the sub-block S may be determined to be the dark block (step S135). In the present exemplary embodiment, the third reference value REF3 is greater than the fourth reference value REF4, and is smaller than the first reference value REF1. For example, in an exemplary embodiment wherein a display device has 0 to 266 gradations, the third reference value REF3 is determined to be 75 gradations and the fourth reference value REF4 is determined to be 50 gradations.

In step S134, when the maximum gradation value GMAX of the sub-block S is greater than the third reference value REF3 and the average gradation value GAVG is greater than the fourth reference value REF4, the sub-block S may be determined to be the normal block (step S136).

It is determined whether or not each image block DB includes at least one sub-block S determined as a subtitle block based on that each of the sub-blocks S is determined as a subtitle block, a dark block or a normal block in step S133, step S135 and step S136, respectively (step 137).

Non-image data influencing display quality does not exist when the image block DB does not include a sub-block S determined as a subtitle block, so that gradation data of an image block DB may be calculated according to a conventional calculation (step S154).

When the image block DB includes at least one sub-block S determined as a subtitle block, gradation data of the image block DB may be calculated excluding a maximum gradation value GMAX of the sub-block S determined as the subtitle block. Thus, since the gradation data of the image block DB is calculated excluding the maximum gradation value GMAX of the sub-block S determined as the subtitle data, an influence of the subtitle data without regard to the luminance of an image may be prevented so that an initial image luminance may be maintained.

In addition, in order to prevent a luminance from decreasing in an image including only characters, when the number of sub-blocks S determined as the subtitle block is no greater than a percentage range of the total number of the sub-blocks S, the maximum gradation value GMAX of the sub-blocks S may be excluded in a calculation. For example, in an exemplary embodiment wherein the number of sub-blocks S determined as the subtitle block is within a range between about 20% to about 30% of the total number of the sub-blocks S, it may be set to exclude subtitle data in a calculation of gradation data of the image block DB.

As described above, the driving block B is driven according to the image block DB; however, the image block DB may be divided into a plurality of imaginary sub-blocks S in a calculation of gradation data required to determine the duty of a driving signal of the driving block B. Thus, an additional driving circuit is not required in accordance with an increasing of the driving block B, and driving limitations according to an increasing of the driving block B are not required. Moreover, since the image block DB is divided into sub-blocks S of a relatively small size, non-image data of a small size such as subtitle data may be removed during a calculation so that accurate calculation may be possible.

As described above, according to exemplary embodiments of the present invention, an image block corresponding to a driving block is divided into a plurality of sub-blocks to use the sub-blocks in a calculation of gradation data in a luminance controlling of the driving block, so that the display quality of an image may be enhanced without additional costs according to an addition of a driving circuit.

The foregoing is illustrative of the present invention and is not to be construed as limiting thereof. Although a few exemplary embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method of driving a light source including a light source module which provides a liquid crystal display (LCD) panel with light and is driven through a dimming method according to a plurality of driving blocks, the method comprising:

dividing each image block of a plurality of image blocks of the LCD panel into a plurality of sub-blocks to calculate gradation data of the respective image block from an external image signal;

determining a duty ratio of a driving signal which drives an individual driving block of the plurality of driving blocks based on the gradation data, the individual driving block corresponding to the respective image block; and driving the individual driving block in accordance with the duty ratio, wherein calculating the gradation data of the image block from the external image signal further comprises:

determining whether each of the sub-blocks includes non-image data;

calculating the gradation data of the respective image block excluding the non-image data of any of the sub-blocks which include the non-image data, determining whether each of the sub-blocks included the non-image data comprises;

obtaining a maximum gradation value and an average gradation value of each of the sub-blocks from the image signal corresponding to the each of the sub-blocks, respectively;

determining whether the maximum gradation value exceeds a first reference value and a difference between the maximum gradation value and the average gradation value exceeds a second reference value which is smaller than the first reference value; and determining the sub-block to be a subtitle block, which includes subtitle data, when the maximum gradation value exceeds the first reference value and the difference between the maximum gradation value and the average gradation value exceeds the second reference value.

2. The method of claim 1, wherein the non-image data comprises subtitle data.

3. The method of claim 1, wherein calculating the gradation data of the image block includes excluding the maximum gradation value of the sub-block that is determined as the subtitle block.

4. The method of claim 1, wherein the number of sub-blocks determined to be subtitle blocks is about 20% to about 30% of the total number of sub-blocks.

5. The method of claim 1, wherein each size of the sub-blocks determined to be subtitle blocks is different from each other.

6. The method of claim 1, wherein determining whether or not each of the sub-blocks includes non-image data further comprises:

determining the sub-block to be a dark block when the maximum gradation value is no greater than the first reference value, a difference between the maximum gradation value and the average gradation value is no greater than the second reference value, the maximum gradation value is less than a third reference value which is smaller than the first reference value, and the average gradation value is less than a fourth reference value which is smaller than the third reference value.

7. The method of claim 1, further comprising compensating a duty ratio between adjacent driving blocks.

8. The method of claim 1, wherein a size of the sub-blocks is greater than a pixel of the LCD panel, and is equal to or smaller than half of the image block.

9. A backlight apparatus comprising: a light source module which provides a liquid crystal display (LCD) panel with light and is driven through a dimming method according to a plurality of driving blocks; and a local dimming driving part comprising: an image analyzing part dividing each image block of a plurality of image blocks of the LCD panel into a plurality of sub-blocks to calculate gradation data of the respective image block from an external image signal;

a duty determining part determining a duty ratio of a driving signal which drives an individual driving block of the plurality of driving blocks based on the gradation data, the individual driving block corresponding to the respective image block; and a light source driving part driving the individual driving block in accordance with the duty ratio, wherein the image analyzing part determines whether each of the sub-blocks includes non-image data, and calculates the gradation data of the image block excluding the non-image data of any of the sub-blocks which include the non-image data, wherein the image analyzing part obtains a maximum gradation value and an average gradation value of each of the sub-blocks from the image signal corresponding to the each of the sub-blocks, respectively;

determines whether the maximum gradation value exceeds a first reference value and a difference between the maximum gradation value and the average gradation value exceeds a second reference value which is smaller than the first reference value; and determines the sub-block to be a subtitle block, which includes subtitle data, when the maximum gradation value exceeds the first reference value and the difference between the maximum gradation value and the average gradation value exceeds the second reference value.

10. The backlight apparatus of claim 9, wherein the image analyzing part determines the sub-block to be a dark block when the maximum gradation value is no greater than the first reference value, a difference between the maximum gradation value and the average gradation value is no greater than the second reference value, the maximum gradation value is less than or equal to a third reference value which is smaller than the first reference value, and the average gradation value is less than or equal to a fourth reference value which is smaller than the third reference value.

11. The backlight apparatus of claim 9, wherein the local dimming driving part further comprises a duty compensation part which compensates a duty ratio between driving blocks B that are adjacent to each other.

12. The backlight apparatus of claim 9, wherein the light source module drives at least one driving block through a dimming method.

13. The backlight apparatus of claim 12, wherein the light source module drives driving blocks, which are divided along a first direction, through a dimming method in which driving is performed in driving blocks.

14. A liquid crystal display (LCD) apparatus comprising: an LCD panel; and a backlight apparatus comprising:

a light source module which provides a liquid crystal display (LCD) panel with light and is driven through a dimming method according to a plurality of driving blocks; and a local dimming driving part comprising: an image analyzing part dividing each image block of a plurality of image blocks of the LCD panel into a plurality of sub-blocks to calculate gradation data of the respective image block from an external image signal, the image analyzing part determines whether each of the sub-blocks includes non-image data, and calculates the gradation data of the respective image block excluding the non-image data;

a duty determining part determining a duty ratio of a driving signal which drives an individual driving block of the plurality of driving blocks based on the gradation data, the individual driving block corresponding to the respective image block; and a light source driving part driving the individual driving block in accordance with the duty ratio, determining whether each of the sub-blocks included the non-image data comprises;

obtaining a maximum gradation value and an average gradation value of each of the sub-blocks from the image signal corresponding to the each of the sub-blocks, respectively;

determining whether the maximum gradation value exceeds a first reference value and a difference between the maximum gradation value and the average gradation value exceeds a second reference value which is smaller than the first reference value; and determining the sub-block to be a subtitle block, which includes subtitle data, when the maximum gradation value exceeds the first reference value and the difference between the maximum gradation value and the average gradation value exceeds the second reference value.

15. The LCD apparatus of claim 14, wherein the light source module drives at least one driving block through a dimming method.

16. The LCD apparatus of claim 14, wherein the light source module drives driving blocks, which are divided along a first direction, through a dimming method in which driving is performed in driving blocks.

* * * * *